US011691850B2

(12) United States Patent
Kasbergen

(10) Patent No.: US 11,691,850 B2
(45) Date of Patent: Jul. 4, 2023

(54) METHOD OF CONFIGURING A PLATFORM LIFT

(71) Applicant: TK HOME SOLUTIONS B.V., Krimpen aan den IJssel (NL)

(72) Inventor: Paul Kasbergen, Capelle aan den IJssel (NL)

(73) Assignee: TK HOME SOLUTIONS B.V., Krimpen Aan Den Ijssel (NL)

( * ) Notice: Subject to any disclaimer, the term of this patent is extended or adjusted under 35 U.S.C. 154(b) by 283 days.

(21) Appl. No.: 17/250,698

(22) PCT Filed: Aug. 14, 2019

(86) PCT No.: PCT/EP2019/071806
§ 371 (c)(1),
(2) Date: Feb. 19, 2021

(87) PCT Pub. No.: WO2020/038794
PCT Pub. Date: Feb. 27, 2020

(65) Prior Publication Data

US 2021/0323791 A1 Oct. 21, 2021

(30) Foreign Application Priority Data

Aug. 21, 2018 (DE) ..... 10 2018 214 040.5

(51) Int. Cl.
*B66B 9/08* (2006.01)
*G08C 17/02* (2006.01)

(52) U.S. Cl.
CPC ..... *B66B 9/08* (2013.01); *G08C 17/02* (2013.01)

(58) Field of Classification Search
CPC ..... B66B 9/08; B66B 1/3461; G08C 17/02
See application file for complete search history.

(56) References Cited

U.S. PATENT DOCUMENTS 4,904,916 A * 2/1990 Gisske ..... B66B 9/083 398/1
8,660,565 B2 * 2/2014 Hall ..... B66B 9/08 455/450

(Continued)

FOREIGN PATENT DOCUMENTS

CA 2736676 A1 10/2011
CN 1620832 A 5/2005

(Continued)

OTHER PUBLICATIONS

Office Action dated Jun. 27, 2019, in German priority application No. DE 102018214040.5.

(Continued)

*Primary Examiner* — Michael A Riegelman
(74) *Attorney, Agent, or Firm* — Dinsmore & Shohl LLP

(57) ABSTRACT

A method of configuring a platform lift, having a drive unit with a communication device and a remote device in communication with the communication device so the remote device provides a user input to the control unit, is disclosed. The method includes uploading a selected country specific setting into the communication device, emitting an introductory signal from the communication device to the remote device, emitting an acknowledgement signal from the remote device back to the communication device, emitting from the communication device a first signal containing information corresponding to the uploaded country specific setting, receiving the emitted first signal at the remote device, configuring the remote device by recognizing the country specific setting in the first signal, selecting at the remote device the same country specific setting, and emitting a confirmation signal from the remote device back to the communication device which conforms to the selected country specific setting.

20 Claims, 4 Drawing Sheets

(56) References Cited

U.S. PATENT DOCUMENTS

| | | | | |
|---|---|---|---|---|
| 9,751,724 | B2 * | 9/2017 | Ooms | B66B 9/08 |
| 10,769,926 | B1 * | 9/2020 | Rogers | G08B 21/0461 |
| 11,059,696 | B2 * | 7/2021 | Kasbergen | B66B 1/3461 |
| 11,401,133 | B2 * | 8/2022 | Boxum | B66B 9/0853 |
| 2003/0139190 | A1 * | 7/2003 | Steelberg | H04H 60/07 709/219 |
| 2007/0051562 | A1 * | 3/2007 | Titchener | B66B 9/0853 187/200 |
| 2009/0146787 | A1 * | 6/2009 | Park | G06K 7/0008 340/10.1 |
| 2010/0314201 | A1 * | 12/2010 | Stannah | B66B 9/0853 187/201 |
| 2011/0278096 | A1 * | 11/2011 | Kentenich | B66B 1/34 187/200 |
| 2015/0068847 | A1 * | 3/2015 | Ooms | H04W 8/22 187/201 |
| 2018/0044133 | A1 * | 2/2018 | Cook | B66B 1/30 |
| 2018/0072537 | A1 * | 3/2018 | Pugh | B66B 9/0853 |
| 2018/0139771 | A1 * | 5/2018 | Kitao | H04M 1/00 |
| 2019/0382243 | A1 * | 12/2019 | Van Eijgen | B66B 9/08 |
| 2020/0017332 | A1 * | 1/2020 | Boxum | B66B 9/0853 |
| 2020/0198928 | A1 * | 6/2020 | Kasbergen | B66B 5/0006 |
| 2021/0323791 | A1 * | 10/2021 | Kasbergen | B66B 9/08 |

FOREIGN PATENT DOCUMENTS

| | | | | |
|---|---|---|---|---|
| CN | 205990136 | U | 3/2017 | |
| EP | 3915923 | A1 * | 12/2021 | B66B 9/08 |
| JP | 2010210266 | A | 9/2010 | |
| JP | 2015514648 | A | 5/2015 | |
| JP | 2016213625 | A | 12/2016 | |
| KR | 2009-0060923 | A | 6/2009 | |
| KR | 2009-0114902 | A | 11/2009 | |
| TW | M557560 | U | 4/2018 | |
| WO | 2016/204177 | A1 | 12/2016 | |
| WO | 2018/052370 | A1 | 3/2018 | |

OTHER PUBLICATIONS

International Search Report in PCT/EP2019/071806 dated Nov. 21, 2019.

Notice of Allowance, dated Jul. 12, 2022, in Japanese counterpart application No. JP 2021-506254, citing the above identified references not yet listed in an information disclosure statement in this pending US application.

Office Action, dated Nov. 26, 2021, in Chinese counterpart application No. CN 201980054159.2, citing the above identified references not yet listed in an information disclosure statement in this pending US application.

* cited by examiner

METHOD OF CONFIGURING A PLATFORM LIFT

CROSS REFERENCE TO RELATED APPLICATIONS

This application is a U.S. National Stage Entry of International Patent Application Serial Number PCT/EP2019/071806, filed Aug. 14, 2019, which claims priority to German Patent Application No. DE 10 2018 214 040.5, filed Aug. 21, 2018, the entire contents of each of which are incorporated herein by reference.

FIELD

The present disclosure generally relates to platform lifts and their configuration.

BACKGROUND

A platform lift is normally mass produced; therefore, any specific requirements pertaining to a specific country are not taken into account during the production process. For example, very often, a different bandwidth of radio frequency (RF) in combination with an effective radiated power (ERP) is required in order to comply with the applicable standards and directives for RF in different countries. This means that each continent or country (to which a platform lift is shipped) has its own specific frequency/power settings. Consequently, the platform lift needs to be produced with customized hardware and software corresponding to the country requirements of the desired location of sale and/or installation. This requirement obviously results in a more complex process of producing a platform lift since it requires that the manufacturer has access to a huge number of country specific components which are selected and inserted into a platform lift according to the end destination. It also results in a very strict manufacturing process with no room for error and a high potential for waste. For example, if the required number of platform lifts for one country unexpectedly 20 decreases, the already produced platform lifts cannot be used to meet the demand in another country since the country specific components would then be incorrect. Accordingly, there are deficiencies in the current practice, and a need exists for an improved method to avoid the aforementioned problems.

DETAILED DESCRIPTION

Figure 1A:
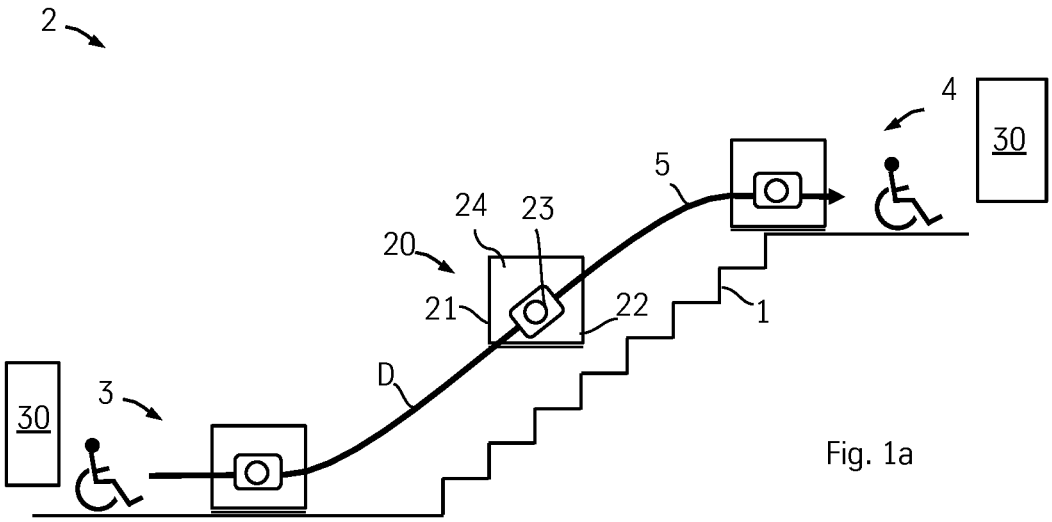
FIG. 1*a* is a schematic view of an embodiment of a platform lift of the present disclosure.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to a method of configuring a platform lift. A method of the present disclosure involves a platform lift that can be appropriately configured according to the specific frequency setting of a country or continent, with the configuring taking place either during the production process, or during the installation process.

In the inventive method of configuring a platform lift wherein the platform lift comprises

- a drive unit comprising a communication device;
- a remote device in communication with the communication device such that the remote device is adapted to provide a user input to the control unit; the inventive method preferably comprises the steps of:
- uploading a selected country specific setting into the communication device;
- optionally emitting an introductory signal from the communication device (24) to the remote device (30) followed by emission of an acknowledgement signal from the remote device (30) back to the communication device (24);
- emitting a first signal comprising information of the uploaded country specific setting from the communication device;
- receiving the emitted first signal at the remote device;
- configuring the remote device by recognizing the country specific setting from the received emitted first signal and selecting at the remote device the same country specific setting;
- emitting a confirmation signal from the remote device back to the communication device which conforms to the selected country specific setting.

It is further preferred that the communication device is a radio frequency (RF) communication device.

The inventive method advantageously utilizes radio frequency (RF) with a range from about 3 MHz to about 3 GHz, preferably with a range from about 300 MHz to about 1 GHz, more preferably with a range from about 850 MHz to about 950 MHz, most preferably with a range from about 860 MHz to about 930 MHz. The term "about" includes any RF value that lies within ±5 MHz of the given range limit. A selected RF signal range can refer to a selected frequency range (e.g., between 800 MHz and 850 MHz), or a selected frequency (810 MHz). Said RF signal range preferably comprises center frequency channels and/or bandwidth channels which support various types of wireless transmissions, for example, listen-before-talk.

In the inventive method, the country specific setting relates to the selected RF signal range. In other words, the selected radio frequency range is preferably specific to a country, or to a collection of countries who share a common radio frequency/frequency range. This advantageously allows the platform lift to be operable in the country (or countries) whose country specific setting has been selected.

It is also envisaged that, for example, a first country specific setting can relate to a first frequency range which is used in e.g., Brazil; a second country specific setting can relate to a first selected frequency used in e.g, China; a third country specific setting can relate to a second frequency range used in the USA; and a fourth country specific setting can relate to a second selected frequency used in e.g. Germany. A combination of frequency ranges and selected frequencies; or all frequency ranges; or all selected frequencies as country specific settings is possible within the scope of the invention. This advantageously provides for one specific data setting to be selected according to a desired country.

In the inventive method, the drive unit advantageously comprises a data memory wherein the country specific settings are stored. It is preferred that the data memory is a piece of memory hardware comprised within the drive unit, or a portable memory carrier, for example a USB data stick. This advantageously allows the platform lift to be programmed at various stages of production or installation using at least one these various programming methods.

In the inventive method, the communication device is preferably uploaded with exactly one country specific setting from the data memory during production or installation of the platform lift. This advantageously provides a platform lift which is "ready to use" upon purchase, or can be made "ready to use" upon installation. Preferably the country specific setting comprised within the data memory is uploaded to the communication device of the drive unit via a parameter signal. Preferably a parameter signal includes the connection of wires/hardware.

In the inventive method, a remote device is provided on a landing area. It can also be provided as a handheld device. It is also possible to provide a remote device on a landing area and as a handheld device. In particular, the remote device can be adapted to be operated at a distance of at least 3 m from the platform lift.

The remote device is adapted to be in communication with the communication device of the drive unit of the platform lift. This communication includes data signals which are sent between the two devices. The data signals preferably include a first signal and a confirmation signal. Said data signals are preferably transferred via a wireless transmission path. Preferably a first signal is sent from the communication device of the drive unit to the remote device. Preferably, a confirmation signal is sent from the communication device of the drive unit to the remote device.

The remote device can also be adapted to "call" the platform lift, i.e., to control the positioning of the platform lift on the stairway so that if the user is on a first landing area and the platform lift is on a second landing area, the user can use the remote device to send a command signal to the platform lift to travel to the first landing area.

Optionally a second remote device can be provided. This second remote device can be configured to operate at short distances from the platform lift, for example, by someone who is assisting a person using a platform lift who is unable to operate the platform lift themselves. This optional second remote device is preferably adapted to operate in the same way as the remote device in the inventive method.

Optionally a third remote device can be provided. This third remote device is preferably provided when the platform lift is to be operated over multiple floors. In a situation where the platform lift is positioned on a third or fourth floor of a building and the user is on the ground floor, the signal of a handheld remote device of the user, or a remote device positioned on the wall of the ground floor is weaker compared to the signal when a platform lift is positioned on the second floor. It is thus preferable to position the optional third remote device on at least one further floor of the building (e.g., first and/or second and/or third and/or fourth) in order to extend or "boost" the radio frequency signal between the remote device on the ground floor and the communication device of the drive unit of the platform lift on the third/fourth floor. The optional third remote device could be provided on the wall of each floor (except for the wall comprising the remote device) or it could be provided to each floor as a handheld device.

FIG. 1*a* shows an exemplary platform lift 2 that can be used with the invention. The platform lift 2 is positioned along a length of staircase 1. A user begins on a first landing area 3 and travels along the staircase 1 to a second landing area 4. The platform lift 2 comprises a drive unit 20 with a drive motor 21, said drive unit 20 comprising a platform 22, a control unit 23 (see FIG. 2) and an RF communication device 24. In this embodiment the platform 22 is adapted to accommodate a wheelchair.

Figure 1B:
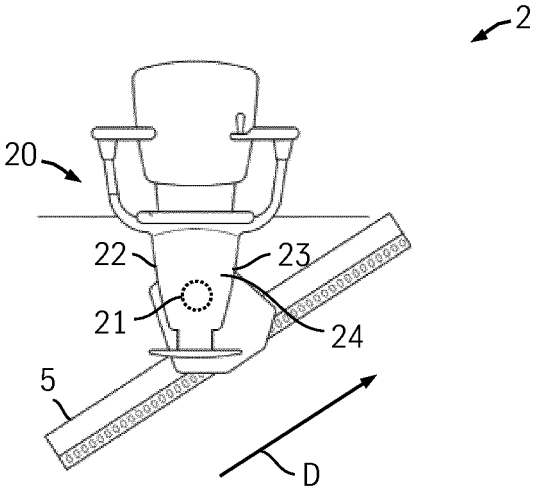
FIG. 1*b* is a schematic view of an alternate embodiment of a platform lift of the present disclosure in which the platform is in the form of a seat.

FIG. 1*b* shows another platform lift 2 that can be used with the invention. The platform lift 2 has a platform in the form of a seat 22. The lift comprises primarily the same components as the platform lift 2 of FIG. 1*a* to which reference is made.

The control unit 23 controls the movement of the platform lift 2. In particular the control unit 23 provides a command which activates the drive motor 21 to move upwards or downwards along the rail 5 at a certain speed.

The platform lift 2 has at least one remote device 30 (shown in FIG. 1*a*) which is located remote to the drive unit 20. The remote device 30 is programmed to receive and emit RF signals. With the remote device 30 the user is able to give commands to the control unit 23. In particular the user should be able to initiate via the remote control 30, the driving of the platform 21 along the rail 5 in a specific direction. In this case, the platform lift is moving upwards from landing area 3 to landing area 4. The RF communication device 24 is provided to enable communication between the control unit 23 and the remote device 30, as will be described later with reference to see FIG. 3.

Figure 2:
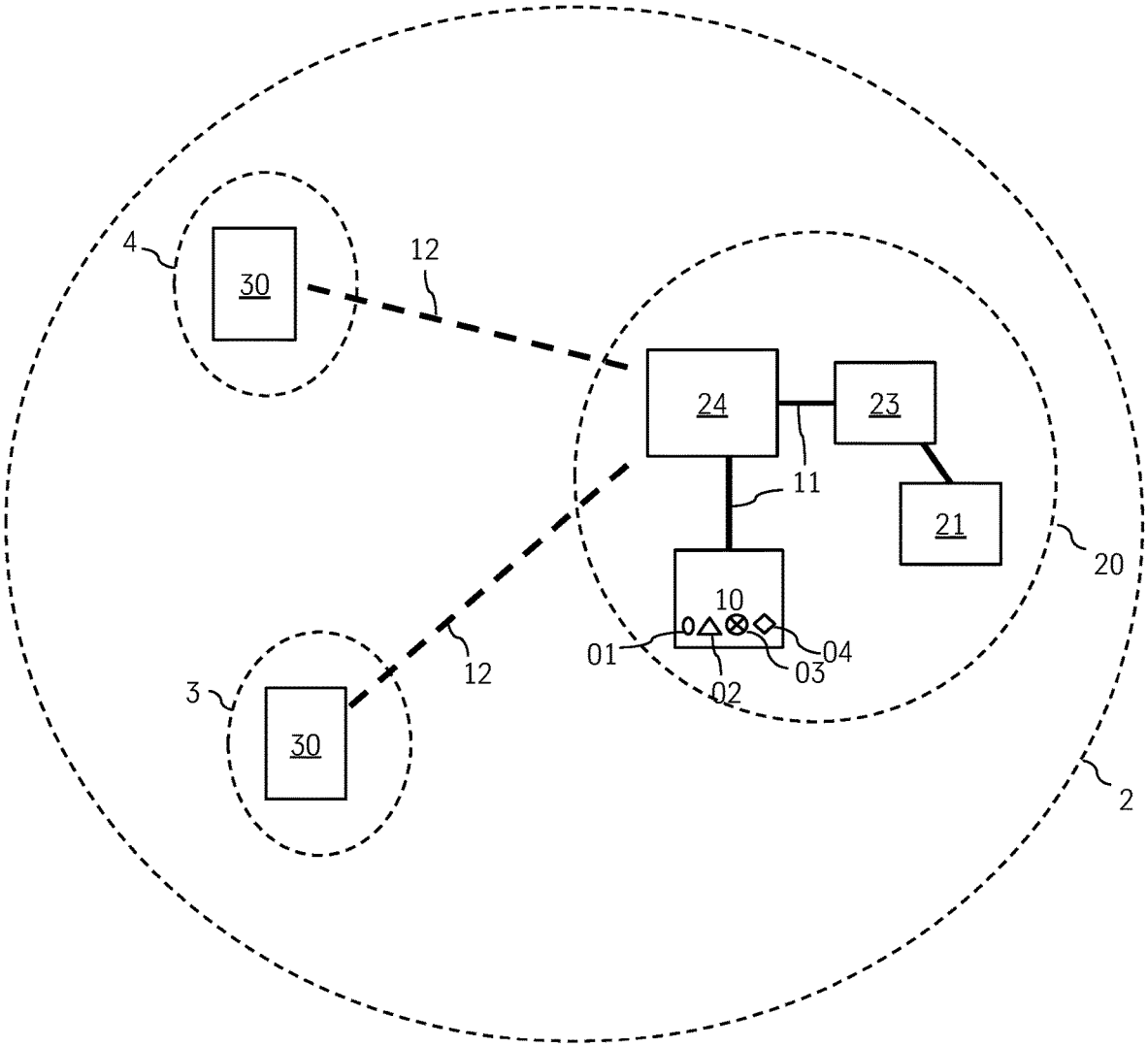
FIG. 2 is a schematic diagram of an embodiment of the main electronic components of a platform lift of the present disclosure.

FIG. 2 shows a schematic diagram of electronic components comprised within the platform lift. These components include the drive unit 20 comprising an RF communication device 24, a data memory 10 and the control unit 23, controlling the drive motor 21. The first remote device 30 which is separate from the drive unit 20, is positioned on a first landing area 3 and the second remote device 30 which is also separate from the drive unit 20, is positioned on a second landing area 4. These components enable the platform lift to be configured according to the specific radio frequency settings of a country or continent. Several wireless data connections 11 between the components within the drive unit 20 are provided. Further a wireless transmission path is provided between each of the remote devices and the RF communication device.

The data memory 10 comprises various country specific settings 01, 02, 03, 04, wherein each setting refers to a different selected frequency or frequency range. The use of four country specific settings (01, 02, 03, 04) is meant by way of example only. The data memory can comprise one or more country specific setting(s). Each stairlift will be dedicated to be delivered to a specific country or region. For this purpose the remote device 30 and the RF communication device 24 needs to paired according to one country/region specific setting.

Figure 3A:
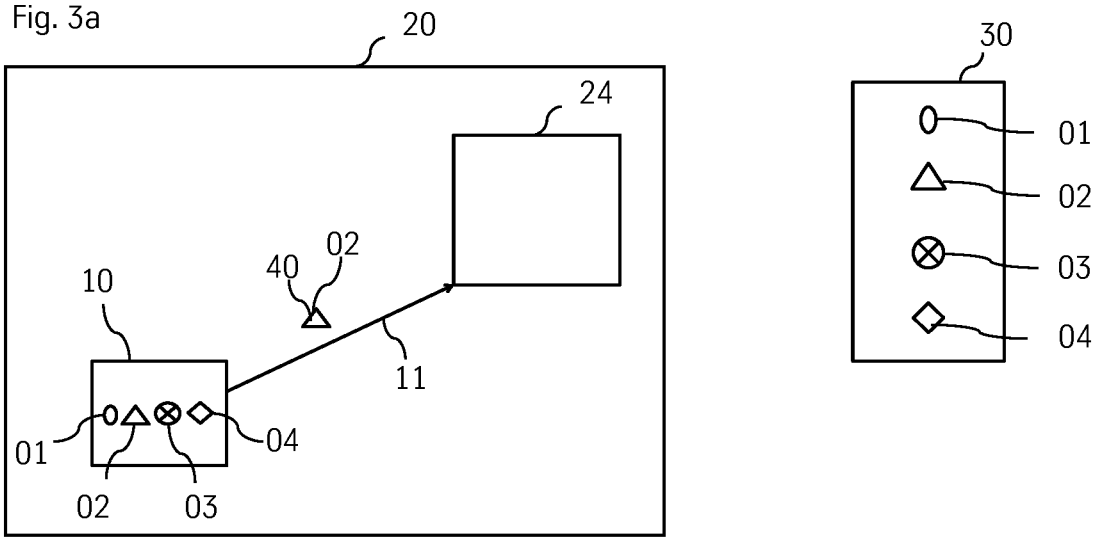
FIG. 3*a* is a schematic diagram showing an embodiment of a first step in a configuration process of a method of configuring a platform lift, as disclosed herein.
Figure 3B:
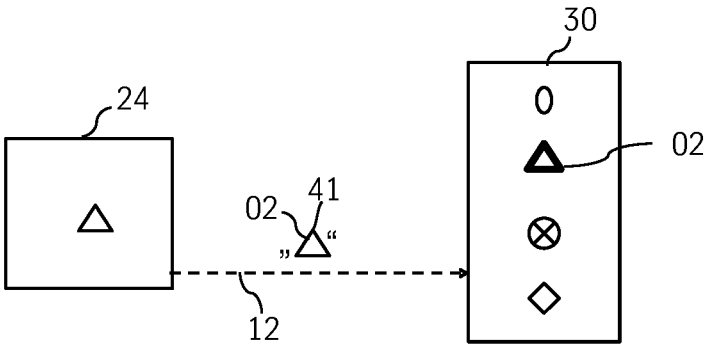
FIG. 3*b* is a schematic diagram showing an embodiment of a second step in the configuration process of FIG. 3*a*, in which an RF communication device of the drive unit has been uploaded with a country specific setting and emits a signal indicating that country specific setting to the remote device.
Figure 3C:
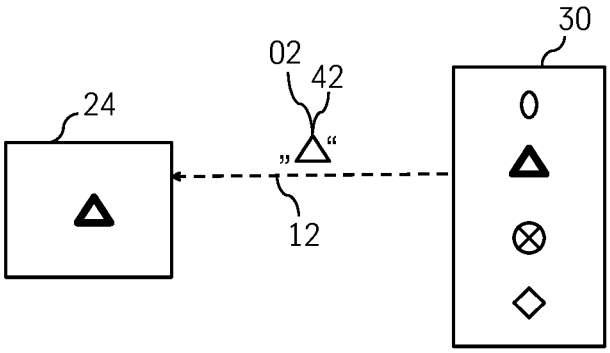
FIG. 3*c* is a schematic diagram showing an embodiment of a third step in the configuration process of FIG. 3*a*, in which, after receiving the country specific setting signal from the RF communication device, the remote device emits a confirmation signal back to the RF communication device.

The main stages of configuring a platform lift according to the invention are shown in FIGS. 3*a* to 3*c*. A data memory 10 and an RF communication device 24 are both comprised within a drive unit 20. The data memory 10 comprises a database having multiple country specific RF settings 01 to 04. For example, setting 01 is the country specific setting for the US, 02 is the country specific setting for Brazil, 03 is the country specific setting for Germany and 04 is the country specific setting for China. Whether the country specific setting is a frequency range or a selected frequency will depend on the available channels in each country.

The remote device 30 is also shown. The remote device 30 comprises the same country specific settings 01 to 04 as those contained in the data memory 10 of the drive unit 20. However, at this stage, due to the lack of country specific setting information (01 to 04) contained within the RF communication device 24 of the drive unit 20, communication between the drive unit 20 and the remote device 30 is not possible. Thus, the platform lift remains deactivated and cannot yet be used for travelling from one floor of a building to another.

A first step in the configuration process requires the uploading of a particular country specific setting 01, 02, 03, 04, from the data memory 10 to the first RF communication device 24. This is shown in FIG. 3*a*. This can be done on the manufacturing site or at the installation site. In the particular example shown in FIG. 3*a*, the country specific setting selected is 02, i.e., Brazil. This means that from now on, the RF communication device 24 "communicates" according to the country specific radio frequency of Brazil. The term "communicates" refers to the ability of the RF communication device 24 to transmit and receive RF data signals. The country specific setting 02 is uploaded to the RF communication device 24 of the drive unit 20 via parameter signal 40 along a data connection 11.

FIG. 3*b* shows the RF communication device 24 of the drive unit 20 after having been uploaded with the country specific setting 02 pertaining to Brazil. The RF communication device 24 emits a first signal 41 relating to the country specific setting 02 along a wireless transmission path 12. At this stage the path 12 is merely a one way path, since the remote device 30 does not know yet, according to which country setting the RF communication device 24 is broadcasting. The first signal 41 contains the information that the RF communication device 24 is broadcasting according to the selected country specific setting 02.

The first signal 41 is received by the remote device 30 which recognizes the setting 02. The remote device 30 then selects the corresponding setting 02 already stored in the remote device, but not yet selected. Once the relevant setting 02 has been selected, the remote device 30 emits a confirmation signal 42 back to RF communication device 24 (see FIG. 3*c*). This results in the pairing of the RF communication device 24 and consequently the drive unit 20 with the remote device 30. Once paired, the platform lift can be activated by sending command signals over this particular RF frequency. Thus mobility of a user between floors of a building is possible. Once both devices are paired, the RF setting 02 is maintained over the lifetime of both the platform lift and the remote device 30.

In FIGS. 3*a* to 3*c*, only one remote device 30 is shown. It is, however, also envisaged that more than one remote device 30 can be used. For example, a remote device 30 can be positioned in the vicinity of the platform lift (e.g. on a wall) of each floor on which the platform lift is adapted to travel to and/or along. Another example of a remote device 30 is a hand-held mobile device that can be used by the user to control the platform lift 2. This is particularly useful when the user is in the vicinity of the platform lift but too far away from the wall mounted remote device 30.

It is further envisaged that a remote device 30 can be positioned on each floor in order to extend or boost and/or maintain any data signal between the drive unit 20 and the remote device 30. This is particularly useful in buildings with more than two floors. In such buildings, the data signal between the drive unit 20 of a platform lift positioned on the ground floor and a remote device 30 positioned on the ground floor has a better quality connection and thus pairing, than the drive unit 20 of a platform lift on the second or third floor with a remote device 30 on the ground floor. In view of this it is foreseen that remote devices can be placed on every floor, or every second floor, or positioned according to necessity throughout the staircase of a building in order to ensure a quality working signal and thus a quality working platform lift.

Figure 4:
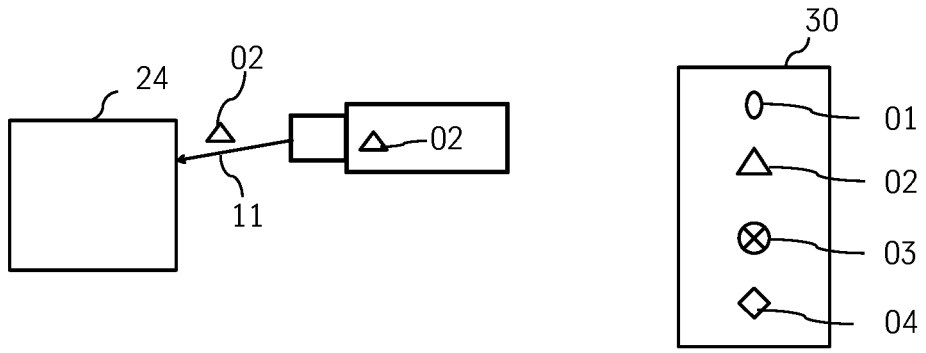
FIG. 4 is a schematic diagram depicting an embodiment of a method of configuring a platform lift of the present disclosure.

FIG. 4 shows another embodiment of configuring a platform lift according to the invention. This embodiment is similar in its particulars to the embodiment shown in FIGS. 3*a* to 3*c*, with the exception that the RF communication device 24 is uploaded with the country specific setting 02 for Brazil via a portable memory carrier, e.g., a USB memory stick. This can be performed during manufacture or installation of the platform lift. Once the RF communication device 24 has been configured according to the settings e.g. for Brazil, the first signal is emitted in the same way as previously described.

REFERENCE SIGNS LIST

1 staircase
2 platform lift
3 first landing area
4 second landing area
5 rail
01 country specific setting, e.g. U.S.
02 country specific setting e.g. Brazil
03 country specific setting e.g. Germany
04 country specific setting e.g. China
10 data memory
11 data connection
12 wireless transmission path
20 drive unit
21 drive motor
22 platform/seat
23 control unit
24 RF communication device
30 remote device
40 parameter signal
41 first signal

42 confirmation signal

D direction of travel

What is claimed is:

1. A method of configuring a platform lift, the platform lift having a drive unit with a communication device, and a remote device in communication with the communication device, the remote device being configured to provide a user input to the control unit, the method comprising:

uploading a selected country specific setting into the communication device;

emitting a first signal comprising information of the uploaded country specific setting from the communication device;

receiving the emitted first signal at the remote device;

configuring the remote device by recognizing the country specific setting from the received emitted first signal;

selecting at the remote device the same country specific setting; and emitting a confirmation signal from the remote device back to the communication device which conforms to the selected country specific setting.

2. The method of claim 1, wherein the communication device is a radio frequency communication device configured to emit and receive a radio frequency signal.

3. The method of claim 2, wherein the radio frequency signal lies in the frequency range of 300 MHz to 3 GHz.

4. The method of claim 2, wherein the radio frequency signal lies in the frequency range of 860 MHz to 930 MHz.

5. The method of claim 2, wherein the remote device is configured to extend the radio frequency signal.

6. The method of claim 2, wherein at least a first remote device and a second remote device are used for radio frequency signal transfer.

7. The method of claim 1, wherein the country specific setting relates to a selected radio frequency signal range.

8. The method of claim 1, wherein the drive unit further includes a data memory in which is stored the country specific settings.

9. The method of claim 8, wherein the data memory is one of a piece of memory hardware within the drive unit, or a portable memory carrier.

10. The method of claim 1, wherein the communication device is uploaded with exactly one country specific setting from the data memory, during one of a manufacture or an installation of the platform lift.

11. The method of claim 1, wherein the remote device is one or more of disposed on a landing area, or a handheld device.

12. The method of claim 1, wherein the remote device is configured to be operated at a distance of at least 3 m from the platform lift.

13. A method of configuring a platform lift, the platform lift having a drive unit with a communication device, and a remote device in communication with the communication device, the remote device being configured to provide a user input to the control unit, the method comprising:

uploading a selected country specific setting into the communication device;

emitting an introductory signal from the communication device to the remote device;

after said emitting of an introductory signal, emitting an acknowledgement signal from the remote device back to the communication device;

emitting from the communication device a first signal containing information corresponding to the uploaded country specific setting;

receiving the emitted first signal at the remote device;

configuring the remote device by recognizing the country specific setting from the received emitted first signal;

selecting at the remote device the same country specific setting; and emitting a confirmation signal from the remote device back to the communication device which conforms to the selected country specific setting.

14. The method of claim 13, wherein the communication device is a radio frequency communication device configured to emit and receive a radio frequency signal.

15. The method of claim 14, wherein the radio frequency signal lies in the frequency range of 300 MHz to 3 GHz.

16. The method of claim 14, wherein the radio frequency signal lies in the frequency range of 860 MHz to 930 MHz.

17. The method of claim 13, wherein the country specific setting relates to a selected radio frequency signal range.

18. The method of claim 13, wherein the drive unit further includes a data memory in which is stored the country specific settings.

19. The method of claim 18, wherein the data memory is one of a piece of memory hardware within the drive unit, or a portable memory carrier.

20. The method of claim 13, wherein the communication device is uploaded with exactly one country specific setting from the data memory, during one of a manufacture or an installation of the platform lift.

* * * * *